US005256338A

United States Patent [19]

Nishi et al.

[11] Patent Number: 5,256,338

[45] Date of Patent: Oct. 26, 1993

[54] SOLIDIFYING MATERIALS FOR RADIOACTIVE WASTE DISPOSAL, STRUCTURES MADE OF SAID MATERIALS FOR RADIOACTIVE WASTE DISPOSAL AND PROCESS FOR SOLIDIFYING OF RADIOACTIVE WASTES

[75] Inventors: Takashi Nishi; Masami Matsuda, both of Hitachi; Itaru Komori, Katsuta; Tsutomu Baba; Koichi Chino, both of Hitachi; Takashi Ikeda, Katsuta; Makoto Kikuchi, Hitachi, all of Japan

[73] Assignee: Hitachi, Ltd., Tokyo, Japan

[21] Appl. No.: 796,829

[22] Filed: Nov. 25, 1991

[30] Foreign Application Priority Data

Nov. 28, 1990 [JP] Japan ..... 2-322866

[51] Int. Cl.[5] ..... G21F 9/16

[52] U.S. Cl. ..... 252/628; 252/633; 210/682

[58] Field of Search ..... 252/628, 633, 626; 210/682, 679; 588/252

[56] References Cited

U.S. PATENT DOCUMENTS

| | | | |
|---|---|---|---|
| 3,716,490 | 2/1973 | Van de Voorde | 252/628 |
| 4,428,700 | 1/1984 | Lennemann | 405/128 |
| 4,452,635 | 6/1984 | Noshi et al. | 106/74 |
| 4,469,628 | 9/1984 | Simmons et al. | 252/629 |
| 4,632,778 | 12/1986 | Lehto et al. | 252/629 |
| 4,659,511 | 4/1987 | Fukasawa et al. | 252/628 |
| 4,659,512 | 4/1987 | Macedo et al. | 252/629 |
| 4,737,316 | 4/1988 | Macedo et al. | 252/633 |
| 4,770,715 | 9/1988 | Mandel et al. | 134/40 |
| 4,778,628 | 10/1988 | Saha et al. | 252/633 |
| 4,793,947 | 12/1988 | Izumida et al. | 252/628 |
| 5,075,045 | 12/1991 | Manchak, Jr. et al. | 252/633 |
| 5,082,602 | 1/1992 | Uetake et al. | 252/627 |

*Primary Examiner*—Donald P. Walsh
*Assistant Examiner*—Ngochan T. Mai
*Attorney, Agent, or Firm*—Antonelli, Terry, Stout & Kraus

[57] ABSTRACT

According to the present invention, a fibrous material having a property to adsorb radioactive nuclides in the form of ion or molecule onto its surface is added to a cement type hydraulic solidifying material used for a solidifying material, a waste container, a structure in disposal site and a back-filling material used for production of a waste form of radioactive wastes, whereby improvement of long-term endurance of the waste form, the structure and the like and diminishment of leaching of radioactivity from the waste form and the like can be simultaneously attained.

37 Claims, 7 Drawing Sheets

SOLIDIFYING MATERIALS FOR RADIOACTIVE WASTE DISPOSAL, STRUCTURES MADE OF SAID MATERIALS FOR RADIOACTIVE WASTE DISPOSAL AND PROCESS FOR SOLIDIFYING OF RADIOACTIVE WASTES

BACKGROUND OF THE INVENTION

1. Field of the Invention

The present invention relates to a solidifying material and a waste container suitable for the final disposal of radioactive wastes generated from a nuclear power plant and the like, a structure for disposal, a back-filling material, and a process for solidifying radioactive wastes.

2. Description of the Related Art

Hitherto, hydraulic inorganic solidifying materials such as cement and water-glass (sodium silicate) have been used for waste containers, solidifying materials, back-filling materials and structures for disposal site of so-called a low level radioactive waste such as a concentrated liquid waste, a spent ion exchange resin and various solids generated from nuclear power plants and nuclear fuel reprocessing facilities.

The above-mentioned hydraulic inorganic solidifying materials have the merits of (1) an easy operation, (2) an inexpensiveness and (3) an excellent radiation resistance and are suitable for disposal of low level radioactive wastes.

Furthermore, for a disposal of low level radioactive wastes, it is necessary that the solidifying materials can maintain safety even under such a condition that solidifying materials or disposal facilities sink under the water and besides can greatly retard leakage of internal radioactive nuclides out of the waste forms or disposition facilities.

A conventional method for assuring long-term endurance of waste forms is to add glass fibers to hydraulic solidifying materials as described in Japanese Patent Kokai (Laid-Open) No. 60-202398. Since fibrous materials have tensile strength several times that of the base hydraulic solidifying materials, they have a reinforcing effect to remarkably improve tensile strength and flexural strength of the whole waste form. Therefore, even if the waste form undergoes a change in volume of the filler or is applied with an external force, cracks or breakage of the waste form do not occur and even in the case of the waste form being disposed into the land, it is considered that the waste form can never deteriorate during from several ten years to several hundred years in which radioactivity decays to sufficiently low level.

Furthermore, for retardation of leakage of radioactive nuclides, Japanese Patent Kokai (Laid-Open) No. 58-40000 has proposed to provide a protective layer for a waste container for radioactive wastes and to embed a filler having ion exchangeability and adsorbability in this protective layer.

Among the above-mentioned conventional methods, the method described in Japanese Patent Kokai (Laid-Open) No. 60-202398 does not consider reduction of leaching rate of radioactivity from wastes and has the problem that a countermeasure to reduce leaching rate of radioactivity is required when wastes higher in level of radioactivity than the present level are disposed of or when wastes containing carbon-14 or technetium-99 longer in half-life are disposed of.

On the other hand, since the invention disclosed in Japanese Patent Kokai No. 58-40000 has not the property to improve the strength of the waste container, the invention has a problem that cracks occur in the waste container due to the cycles of dry/wet and hot/cold of the disposal site, and hence the maintenance of soundness thereof is impossible.

SUMMARY OF THE INVENTION

The object of the present invention is to provide solidifying materials, for disposal of radioactive waste (solidifying materials for making waste form, back-filling materials used in disposal site and so on) and structures for radioactive waste disposal (waste containers, structures of disposal site and so on) which can simultaneously attain improvement of long-term endurance of waste form and the like and reduction of leaching rate of radioactivity from waste form and the like.

The above object has been attained by adding fibrous materials having property to adsorb onto the surface the radioactive nuclides in the form of ion or molecule to cement type hydraulic solidifying materials which are used for solidifying materials for disposal of radioactive wastes (solidifying materials for making waste forms and back-filling materials used in disposal site), waste containers and structures of disposal site.

The fibrous materials which have the property to adsorb on the surface thereof the radioactive nuclides in the form of ion or molecule and are added to cement type hydraulic solidifying materials as a base material have the following actions.

Since the fibrous materials have a tensile strength several times the strength of said base material, they have an action to enhance tensile strength of final hardened bodies depending on the addition amount thereof. Besides, from the point of fracture mechanics, the above fibrous materials have an action to stop the development of cracks which have occurred in the hardened bodies and hence can markedly increase brittle fracture value of set bodies which are inherently brittle materials and can inhibit deterioration of the waste forms.

Especially, when solidifying materials, waste containers, structures of disposal site and back-filling materials which concern with disposal of radioactive wastes undergo wet-and-dry cycle or temperature cycle, cracks may occur in hardened bodies. Leakage of radioactivity from waste forms of wastes when they sink under the water is accelerated owing to these fine cracks. When the above-mentioned fibrous materials are added, not only the final tensile strength of the waste forms is improved, but also generation of fine cracks and development thereof can be prevented not so as to affect mechanical strength. Therefore, increase of leaching rate of radioactivity from waste forms can be prevented even under such severe environmental conditions as dry-and-wet cycle or temperature cycle.

Furthermore, since the fibrous materials have the property to adsorb radioactive nuclides in the form of ion and molecule, distribution coefficient of the solidifying materials as base materials for radioactive nuclides can be improved by the addition of the fibrous materials and leaching rate of radioactivity from waste form can be diminished.

DESCRIPTION OF THE PREFERRED EMBODIMENTS

One example of the present invention will be explained referring to the accompanying drawings.

Incidentally, it should be understood that we intend to cover by the appended claims all modifications falling the true spirit and scope of our invention.

Figure 1:
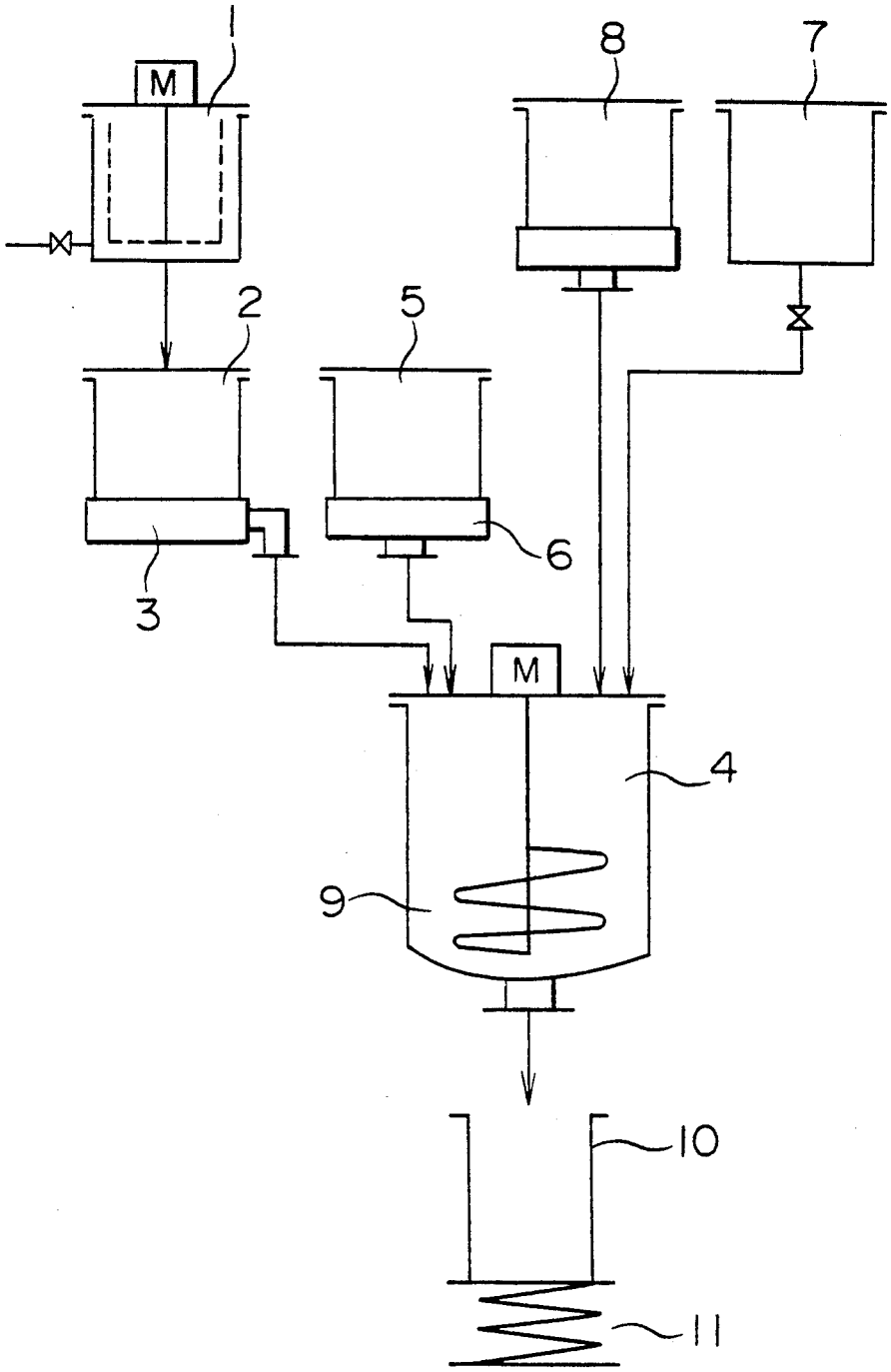
FIG. 1 is a system flow chart to solidify spent ion exchange resin which is one example of the present invention.

FIG. 1 is a system flow chart of solidifying a spent ion exchange resin (waste resin) generated from nuclear power plants in a waste container with a cement type hydraulic setting material.

A waste resin slurry generated from a nuclear power plant is supplied to resin hydro-extractor 1 and dehydrated to about 50% in water content by centrifugal dehydration. The dehydrated waste resin is sent to resin receiver tank 2 and is adjusted to a given amount by feeder 3 and supplied to kneading tank 4 This waste resin has trapped several kinds of radioactive nuclides in the form of ion or solid.

Next, to kneading tank 4 are fed kneading water from additive water tank 7, cement powders from cement silo through feeder 6, and fibrous active carbon from additive hopper 8 in given amounts and these are forcedly kneaded by agitating blades 9 to prepare a paste. The resulting paste is poured in waste container 10 and then cured and set to make a waste form. If vibration is applied by vibration applicator 11 at the time of pouring of paste, a good waste form containing few bubbles therein can be obtained.

Besides the above explained process, it is also possible to directly supply the dehydrated waste resin, the cement powders and the fibrous active carbon to the waste container and agitate the mixture to obtain a waste form.

Next, this example will be specifically explained.

In this example, a waste form was prepared as shown in CASE 1 in Table 1. For comparison, a waste form was also prepared without using fibrous active carbon as shown in CASE 2.

TABLE 1

| Composition of waste form | Case 1 | Case 2 |
|---|---|---|
| Type C blast furnace cement | 150 kg | 150 kg |
| Waste resin | 120 kg | 120 kg |
| Additive water | 50 kg | 50 kg |
| Fibrous active carbon | 5 kg | 0 kg |

The cement powder used here was type C blast furnace cement but there may also be used cement glass which is a setting material comprising a mixture of cement and sodium silicate powder, silica cement, alumina cement, fly ash cement, cements resistant to sulfates, and the like. "Cement type hydraulic solidifying agents" here is a general term for these cements. To the additive water was previously added about 2% of a water reducing agent ($\beta$-naphthalenesulfonate high condensates).

The fibrous active carbon used was made from tar as a starting material and had the following properties; thickness: 15 $\mu$m, length: 3 mm, specific surface area: 1500 $m^2/g$, and average pore diameter of surface micropores: 20 Å.

After lapse of curing period of 4 weeks, the resulting waste form was subjected to core balling to make many test samples of about 0.1 liter and these test samples were subjected to drying cycle test which comprised dipping in water→drying by air stream of 70° C.→dipping in water. Compressive strength of the test sample was measured in each cycle and soundness of the waste form was examined.

Whether there occurred cracks inside the waste form due to dry-and-wet cycle or not can be detected by change in compressive strength.

Figure 2:
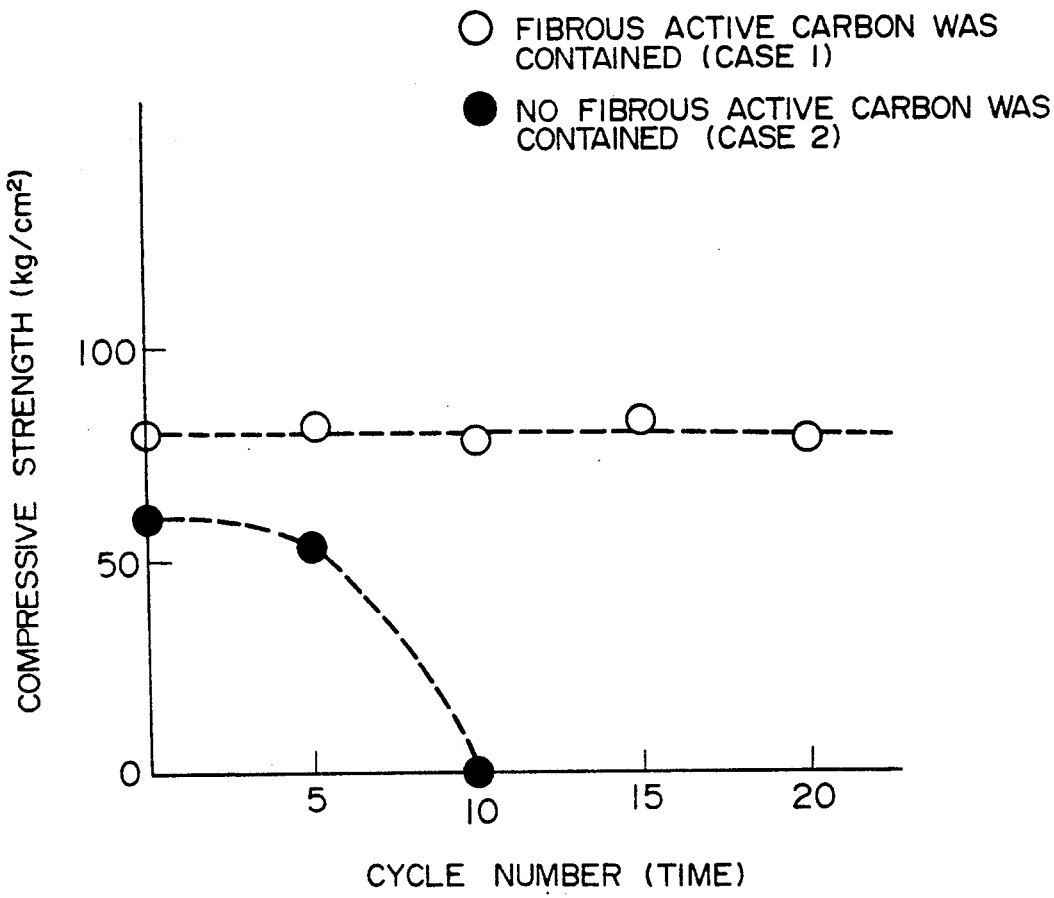
FIG. 2 is a graph which shows change of compressive strength with increase in the number of dry-and-wet cycle.

FIG. 2 is a graph which shows change in compressive strength with increase in the number of dry-and wet cycle. Plot of white circles shows the waste form of CASE 1 and plot of black circles shows the waste form of CASE 2.

In the case of the waste forms of CASE 2 which contained no fibrous active carbon, cracks began to occur when the number of the dry-and-wet cycle exceeded 5 cycles and the waste forms were broken at 10 cycles.

On the other hand, the waste forms of CASE 1 which contained the fibrous active carbon showed no reduction in compressive strength even after 20 cycles and were sound and safe.

Next, a part of the waste forms of CASE 1 and CASE 2 were sampled and ground in a mortar. One gram of each of the resulting samples was dispersed in a distilled water containing 100 $\mu$Ci of carbon-14 and 100 $\mu$Ci of cesium-134 and the dispersion was vibrated in a water bath incubator at 25° C. Then, distribution coefficient of carbon-14 (anion) and cesium-134 (cation) of the set bodies of both CASES was measured. In measurement, a liquid scintillation counter was used for carbon-14 and a pure Ge semiconductor detector was used for cesium-134. The results are shown in Table 2. It is generally known that leaching rate of radioactivity from waste form when the waste form is submerged is inversely proportional to square root of distribution coefficient of the solidifying material.

TABLE 2

| | Distribution coefficient (relative value) | |
|---|---|---|
| | CASE 1 | CASE 2 |
| Carbon-14 | 150 | 1 |
| Cesium-134 | 50 | 1 |

As can be seen from Table 2, leaching rate of radioactivity from the waste form of CASE 1 was reduced to about 1/12 and about 1/7 that from the waste form of CASE 2 for carbon-14 and for cesium-134, respectively.

That is, endurance of waste form can be improved and leaching rate of radioactivity can be reduced by adding some amount (<5% by weight) of fibrous active carbon to conventional cement type solidifying materials.

Fibrous active carbon has innumerable micropores (pore diameter 20Å) on the surface which have the property to mainly physically adsorb radioactive nuclides in the state of ion or molecule. Therefore, the fibrous active carbon has no polarity in adsorption characteristics and has the action to adsorb both the nuclides which basically take the form of cation in liquid and the nuclides which basically take the form of anion in liquid, thereby to retard leaching out of the nuclides. It also has the property of having high distribution coefficient for carbon-14 which takes the form of anion or organic carbon aid for which there has been no effective process to retard leaching out thereof.

With reference to the shape of the fibrous active carbon, the reinforcing effect is higher with increase of aspect ratio (length of fiber/thickness of fiber), but kneading property or pouring property deteriorates with increase of the aspect ratio. Therefore, the aspect ratio can be freely adjusted, but is preferably in the range of 200–300.

When the fibrous active carbon is used in combination with an adsorbing material for cation, the effect to diminish the leaching rate of radioactive nuclides in the form of cation can further be enhanced.

In this example, use of fibrous active carbon has been explained, but similar results can be obtained by using ion exchange fibers and alkali metal titanate fibers.

Ion exchange fibers which consist of base polymer and functional group, adsorb ions of radioactive nuclides dissolved in water by ion exchange reaction to functional group such as sulfonic acid group, carboxyl group, quaternary ammonium group and the like. Since polarity of ions which can be adsorbed differs depending on the kind of the exchange groups, nearly all of nuclides can be adsorbed by mixing cation exchange fibers and anion exchange fibers.

Furthermore, in the case of the alkali metal titanate fibers, nuclides are adsorbed by ion exchanging between alkali metal ions present between layers of titania layer structure and the nuclides which are in the form of cation in liquid. Therefore, the effect to retard leaching is exhibited only on cation nuclides and no effect is exhibited on anion nuclides such as carbon-14 and neutral molecules. Besides, since alkali metal titanate fibers have a specific gravity of 3 or more and may sediment in the paste of solidifying material, apparent specific gravity of the fibers is preferably adjusted to 1.5–2.5.

The above explained fibrous materials (fibrous active carbon, ion exchange fibers and alkali metal titanate fibers) may also be used in the form of a blend of two or more depending on kind and amount of nuclides contained in wastes.

Another example of the present invention will be explained. The embodiment of this example is suitable for solidifying spent ion exchange resins generated from nuclear power plants in a waste container.

The system used in this example is the same as shown in FIG. 1. A waste form was prepared by adding powdered active carbon or fibrous active carbon from additive hopper 8. Distribution coefficient of carbon-14 in the waste form and maximum amount of the resin which can be packed were investigated by experiments with optionally changing addition amounts of the powdered active carbon and the fibrous active carbon.

The maximum amount of resin which can be packed means a maximum addition amount with which a compressive strength of at least 30 kg/cm$^2$ of a waste form can be secured when the waste form is prepared through curing for 1 month and is further dipped in water for 1 month.

Figure 3:
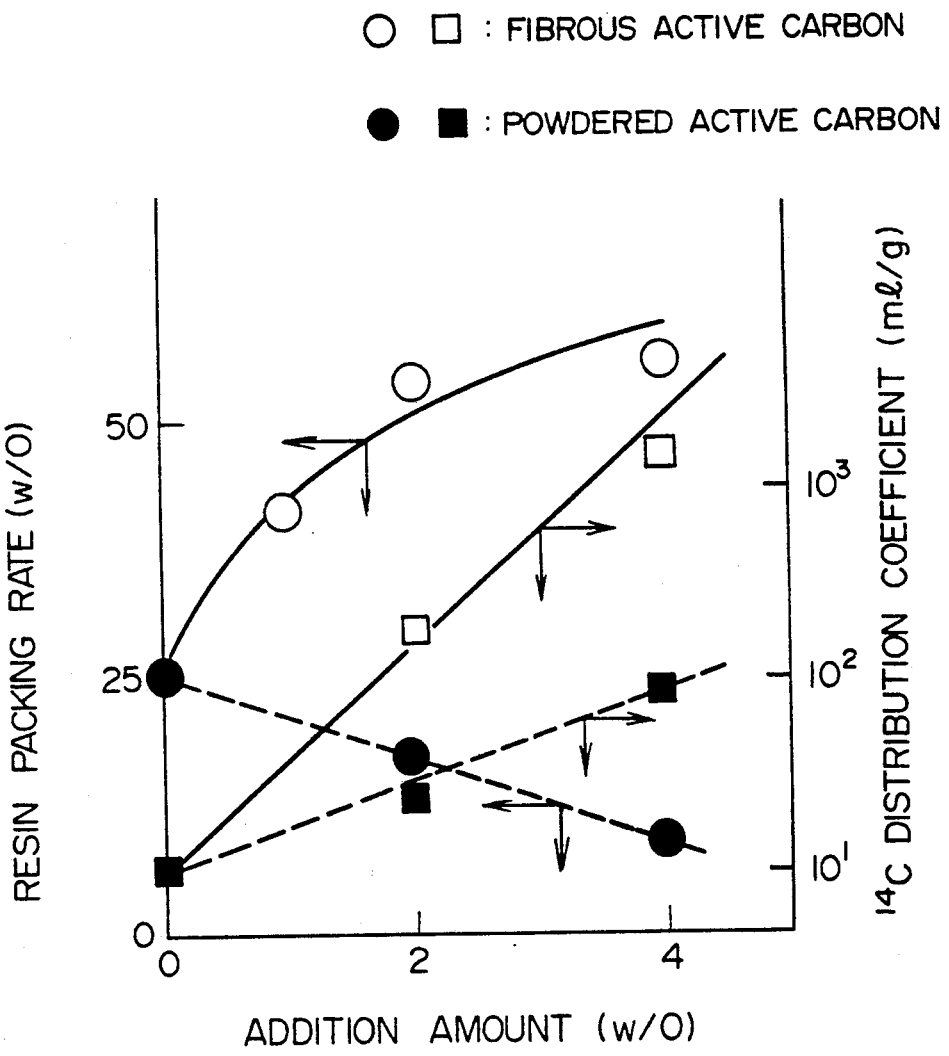
FIG. 3 is a graph which shows relations between amount of additives and resin loading and distribution coefficient of C-14.

FIG. 3 shows the results of the above experiments and is a graph which shows relations between amount of the additive and resin packing rate, namely waste loading, or distribution coefficient of C-14. In the case of the waste form prepared by adding powdered active carbon which is indicated by the plots of black circles and squares, distribution coefficient of carbon-14 increased with increase in addition amount and the effect to reduce leaching rate of carbon-14 was exhibited, but the maximum amount of resin which can be packed decreased, resulting in decrease of strength of the waste form per se.

On the other hand, in the case of the waste form prepared by adding the fibrous active carbon which is indicated by the plots of white circles and squares, the maximum resin packing rate and the carbon-14 distribution coefficient body increased with increase of addition amount. That is, when addition amount is 4% by weight, the maximum resin packing rate is more than twice the maximum resin packing rate when the fibrous active carbon is not added. Moreover, the distribution coefficient of carbon-14 is as high as several times that of carbon-14 when powdered active carbon is added.

Further, the distribution coefficient of carbon-14 can be increased with increase of addition amount of the fibrous active carbon, but kneading property and pouring property of the solidifying material and the paste decrease. Therefore, addition amount of the fibrous active carbon is generally 10% by weight or less, preferably 5% by weight or less. The fibrous active carbon exhibits the effect when it is added even in a small amount and lower limit thereof is about 0.1% by weight.

On the other hand, the powdered active carbon can be added in an amount of up to about 10% by weight in view of resin packing rate.

From the above, it can be seen that distribution coefficient of solidifying material for carbon-14 which has been small can be increased by adding powdered active carbon or fibrous active carbon.

Moreover, in the case of fibrous active carbon, mechanical strength of set body increases and hence, packing rate of wastes can be enhanced.

Since these additives trap nuclides mainly by physical adsorption, they have the same effect for radioactive nuclides in the form of neutral molecule irrespective of cation or anion.

Figure 4:
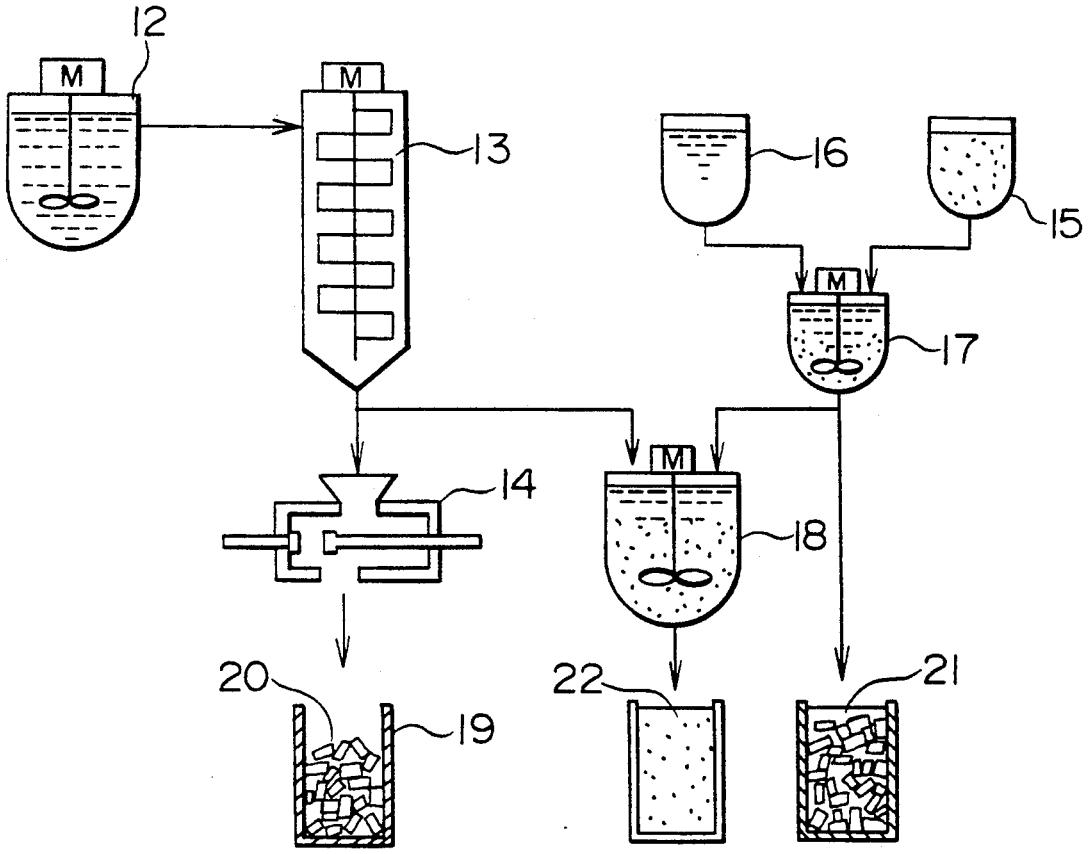
FIG. 4 is a system flow chart to solidify concentrated liquid waste which is another example of the present invention.

Another example of the present invention will be explained referring to FIG. 4.

This example is suitable for disposal by solidifying radioactive concentrated liquid wastes generated from nuclear power plants or nuclear fuel reprocessing facilities.

A concentrated liquid waste containing about 20% of sodium sulfate is temporarily stored in waste liquor tank 12. First, the concentrated liquid waste is fed to centrifugal thin film drier 13 and is powdered therein. The dry powder is transferred, as it is, to kneading tank 18 and is mixed with a solidifying material to make waste form 22. Alternatively, the waste liquor is put in waste container 19, in which a paste of a separately kneaded solidifying material is poured to make waste form 21.

A type C blast furnace cement premixed with 4% by weight of fibrous active carbon (diameter: 10 μm and length: 3 mm) which is a reinforcing material having nuclide adsorbability is used in setting tank 15. It is needless to say that so-called cement glass, silica cement, alumina cement, fly ash cement, sulfate resistant cement and the like which are the above-mentioned cement type hydraulic solidifying materials can be used in place of the blast furnace cement. This solidifying material is kneaded with kneading water fed from the additive water tank in kneading tank 17 at a suitable blending ratio to prepare a paste. It is desired to previously add about 2% of β-naphthalenesulfonate type high performance water reducing agent to the additive water.

This example will be specifically explained. In this example, the dry powder of concentrated liquid waste was directly mixed with the paste of solidifying material. Amount of the dry powder was changed within the range of 0–50% by weight and waste forms were prepared using a solidifying material premixed with 4% by weight of fibrous active carbon and a solidifying material containing no fibrous active carbon. The ratio of water/solid was 0.4. In the case of adding 10% of the dry powder, $^{99}TcO_4^-$ which was added as a tracer in an amount of 100 μCi per one waste form. Compressive strength of respective waste forms was measured and besides, radioactivity leaching test was conducted.

Figure 5:
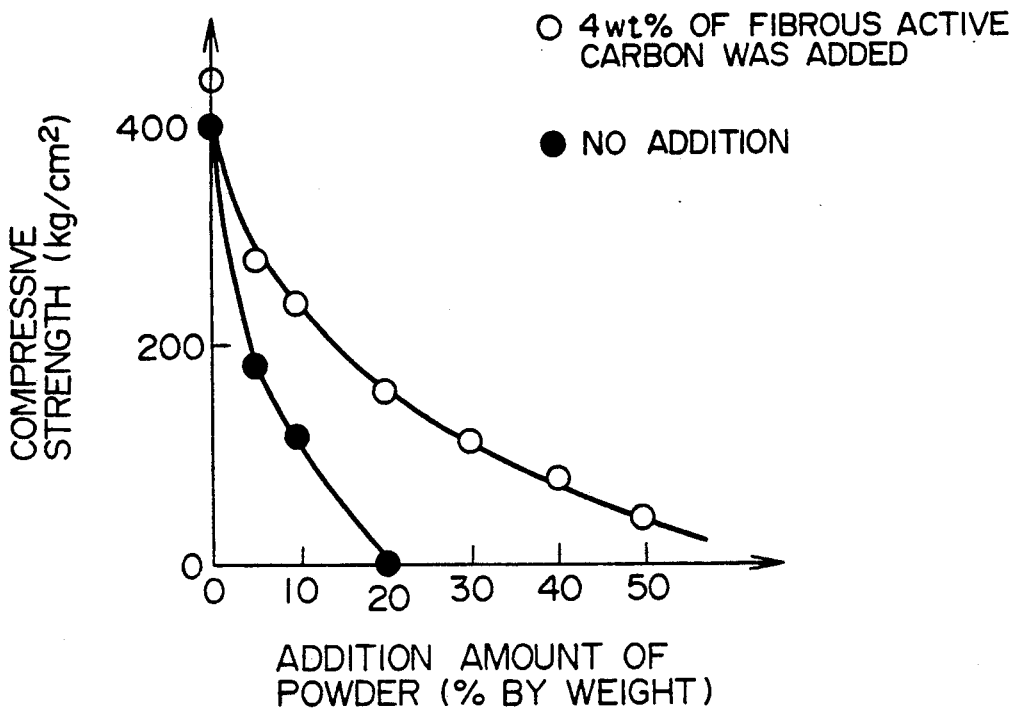
FIG. 5 is a graph which shows relation between addition amount of dry powders and compressive strength of waste form.
Figure 6:
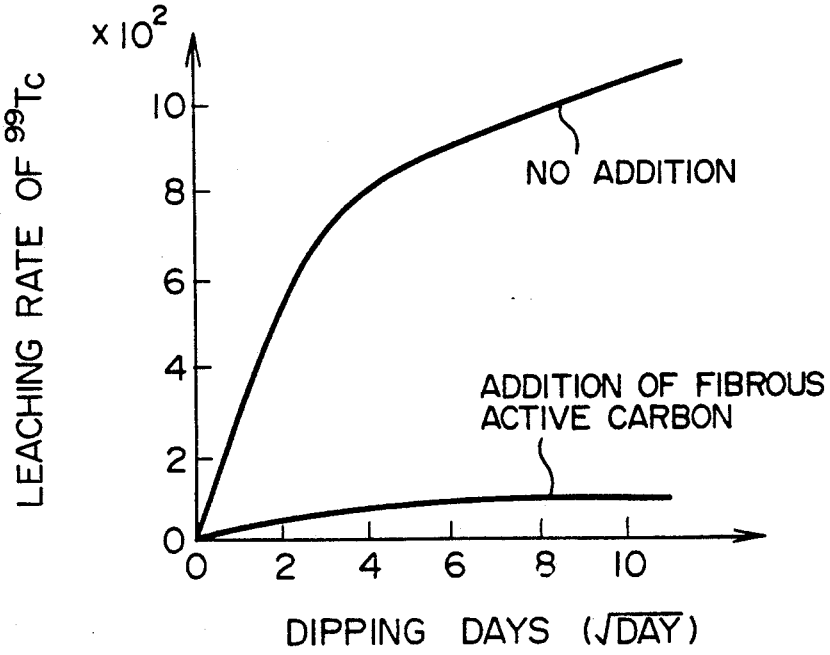
FIG. 6 is a graph which shows results of leaching test of Tc-99.

FIG. 5 shows results of measurement of compressive strength of the waste forms after dipped in water for 1 month and FIG. 6 shows results of the radioactivity leaching test. In FIGS. 5 and 6, the results obtained when fibrous active carbon was added and when it was not added are shown in comparison.

It can be seen from FIG. 5 that even if the addition amount of the dry powder is twice as much, the waste forms have sufficient strength by adding the fibrous active carbon.

It can be seen from FIG. 6 that leaching rate of technetium-99 can be reduced by about one figure and the fibrous active carbon is effective especially for solidifying wastes of higher radioactivity level than conventional wastes.

For reduction of leaching of nuclides in the form of cation, cation exchange fibers and alkali metal titanate fibers are effective and can be used as substitutes for fibrous active carbon. Furthermore, mixed fibers of cation exchange fibers and anion exchange fibers or mixed fibers of fibrous active carbon and alkali metal titanate fibers are more effective.

In the case of using alkali metal titanate fibers, care must be given to sedimentation of fibers because specific gravity of the fibers is at least 3 which is greater than that of general cement. Therefore, it is necessary to reduce diameter of the fibers or length of the fibers. In this case, however, strength of fibers may decrease or the advantageous effect to inhibit occurrence of cracks may be lost. Thus, as an alternative method, sedimentation of fibers can be inhibited by increasing the viscosity of cement paste to such extent that pouring and kneading of cement paste is not hindered. In this case, the viscosity of cement paste is desirably in the range of about 3000 to 5000 cp.

Furthermore, when dry powder is pelletized and then a paste of solidifying material is poured therein to solidify the pellets in this example, viscosity of the paste of setting material and length of the fibers must be taken into consideration.

That is, when the paste is spontaneously poured without application of vibration by vibrator, the viscosity of the paste of solidifying material must be 3000 cp or less, preferably 2000 cp of less. Even in the case of packing under vibration, a dense waste form free from void can be prepared by employing 5000 cp or less as viscosity of the paste of solidifying material. With reference to length of fibers, when fibers of higher aspect ratio are used, sometimes the fibers localize since the fibers are liable to retain in the spaces between pellets. In such case, aspect ratio is preferably controlled to less than 100 though reinforcing effect somewhat deteriorates.

Another example of the present invention will be explained referring to FIG. 7. This example relates to a waste container suitable for solidifying of radioactive wastes generated from nuclear power plants.

Figure 7:
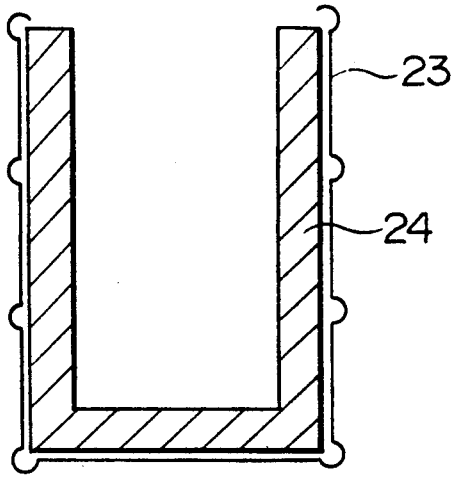
FIG. 7 is a sectional view of a waste container which is another example of the present invention.

As shown in FIG. 7, the waste container comprises iron drum 23 having an inner lining of concrete container 24, but the concrete container 24 alone ca be used as the waste container.

The concrete container 24 is composed of a cement, a fine aggregate, a coarse aggregate, and a nuclide adsorbing reinforcing material. As the cement, there may be used the above-mentioned cement type hydraulic solidifying materials, for example, so-called cement glass, silica cement, alumina cement, fly ash cement, sulfate cement and besides, portland cement and blast furnace cement. As the fine aggregate, there may be suitably used river sand, silica sand, silica fume, fly ash, blast furnace granulated slag fine powder, chamotte, and the like. Examples of the coarse aggregate are ballast and ground rock and the like. Examples of the nuclide adsorbing reinforcing material are fibrous active carbon, ion exchange fibers, and alkali metal titanate fibers.

Standard composition of concrete container 24 is shown in Table 4.

TABLE 4

| | |
|---|---|
| Ordinary portland cement | 10 kg |
| River sand | 5 kg |
| Ballast | 2 kg |
| Fibrous active carbon | 0.6 kg |
| Kneading water | 7 kg |
| High-performance water reducing agent | 0.2 kg |

Maximum size of the coarse aggregate is most suitably about ½ of fiber length considering the reinforcing effect of fibers, but this coarse aggregate may be omitted.

Figure 8:
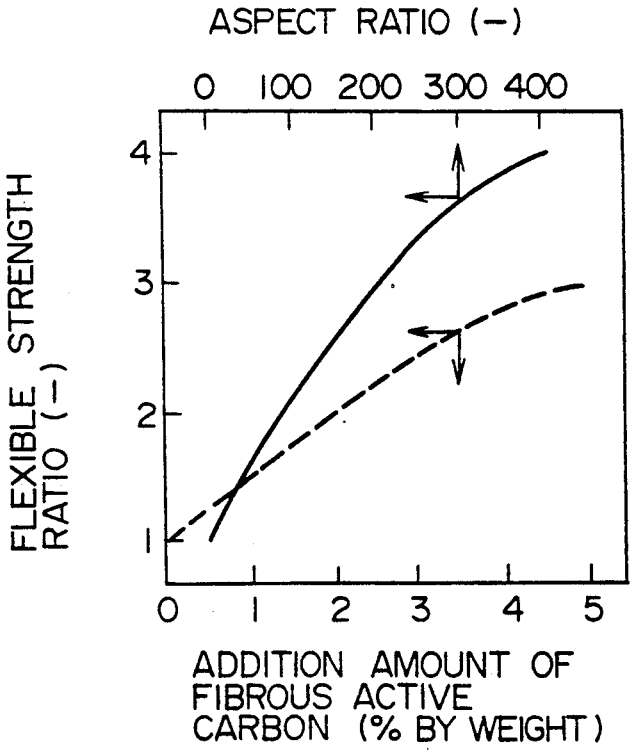
FIG. 8 is a graph which shows relations between flexural strength and addition amount of fibrous active carbon and aspect ratio of fibrous active carbon.

When addition amount of the fibrous active carbon and aspect ratio of the fibrous active carbon in the composition as shown in the above Table 4 are changed, flexural strength of the waste container changes as shown in FIG. 8. With increase in the addition amount and the aspect ratio, flexural strength can be increased, but in order to avoid deterioration of kneadability of the paste and pourability of the paste into a form, addition amount of the fibrous active carbon is preferably 5% by weight or less and aspect ratio is preferably about 200–300.

According to this example, flexural strength of the waste container can be increased and impact resistance and cracking resistance can be improved. Moreover, since adsorbability of radioactive nuclides can be imparted to the waste container, leaching of nuclides from radioactive wastes packed in the waste container can be diminished. Besides, since electrical conductivity of the waste container can be enhanced, local corrosion of the drum can also be diminsihed.

Water stopping property and resistance to radioactivity leaching can be further improved by impregnating the waste container with a polymer such as PMMA (polymethyl methacrylate) through the surface of the container.

Another example of the present invention will be explained referring to FIG. 9. This example relates to pits and back-filling materials in disposal of radioactive wastes on the land.

Figure 9:
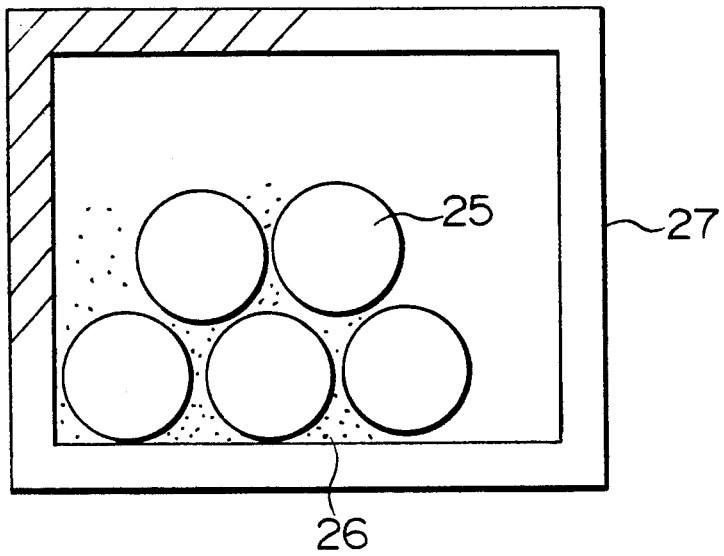
FIG. 9 is a sectional view of structure of disposal site which is another example of the present invention.

As shown in FIG. 9, waste forms 25 in which radioactive waste was packed and was solidified are placed in pit 27 and space between the waste forms is filled with back-filling material 26.

As pit 27, a reinforced concrete structure or a prestressed concrete structure of the composition as shown in Example 4 is suitable.

As the back-filling materials, those which have the following composition are suitable.

TABLE 5

| | |
|---|---|
| Type C blast furnace cement | 70 kg |
| Natural zeolite | 30 kg |
| Fibrous active carbon | 3 kg |
| Additive water | 1 kg |
| High-performance water reducing agent | 1 kg |

In place of type C blast furnace cement, there may be used above-mentioned cement glass, silica cement, alumina cement, fly ash cement, sulfate cement and the like which are cement type hydraulic solidifying materials. Moreover, a part of the type C blast furnace cement may be replaced with fine aggregate. The back-filling materials preferably have high flowability and when viscosity thereof is lower than 2000 cp, pouring becomes easy. Furthermore, when natural zeolite is added to the back-filling material as in this example, leaching of cation nuclides can be retarded to the lower level. In addition to natural zeolite, addition of natural minerals or clay minerals such as bentonite, montmorillonite, vermiculite, kaolinite, and clinoptilolite can also control leaching of cation nuclides to the lower level. Moreover, according to this example, not only improvements in endurance and weathering resistance of the pits or back-filling materials in disposition places can be attained, but also leaching rate of radioactive nuclides such as carbon-14 and others can further be reduced.

Another example of the present invention will be explained referring to FIG. 10. This example relates to a reinforced concrete structure contiguous to the sea.

Figure 10:
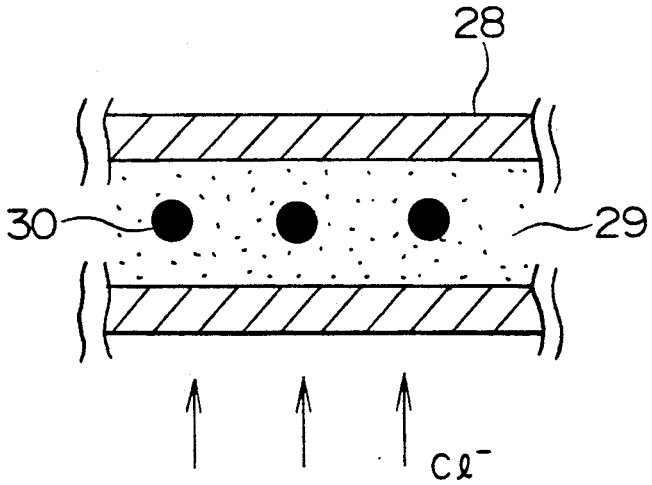
FIG. 10 is a sectional view of a structure contiguous to the sea which is another example of the present invention.

As shown in FIG. 10, concrete layer 28 to which the ion adsorbing reinforcing material of the present invention is added is provided on the side contiguous to the sea of a reinforced concrete structure comprising conventional general concrete layer 29 and reinforcement 30, whereby corrosion of the reinforcement 30 due to diffusion and penetration of chlorine ion contained in seawater can be considerably decreased and life of the structure can be prolonged.

As explained above, the present invention provides a solidifying material, a waste container, a structure of disposal site and a back-filling material according to which improvement in long-term endurance and diminishment in leaching rate of radioactivity from wastes can be simultaneously attained.

In addition, the present invention provides a solidifying process of radioactive wastes which can simultaneously attain improvement in long-term endurance and diminishment in leaching rate of radioactivity from wastes.

What is claimed is:

1. A solidifying material for disposal of radioactive wastes in solidified waste form which comprises a mixture of a cement type hydraulic solidifying material and a fibrous material having a property to adsorb radioactive nuclides in the radioactive waste in the form of ion and/or molecule onto its surface, and to increase retention of the radioactive wastes within said waste form; the fibrous material also having a property to increase the tensile strength of the waste form, thereby increasing the waste loading within said waste form.

2. A structure for disposal of radioactive wastes at least a part of which is made of a cement type hydraulic solidifying material wherein said cement type hydraulic solidifying material contains a fibrous material having a property to adsorb radioactive nuclides in the radioactive wastes in the form of ion and/or molecule onto its surface, and to increase retention of the radioactive wastes in said structure; said fibrous material also having property to increase the tensile strength of said structure, thereby increasing the waste loading in said structure.

3. A structure according to claim 2, wherein the structure is a waste container for radioactive wastes at least a part of which is composed of the cement type hydraulic solidifying material.

4. A structure according to claim 2, wherein said structure is a structure in a disposal site for radioactive wastes at least a part of which is composed of the cement type hydraulic solidifying material.

5. A solidifying material according to claim 1, wherein the fibrous material having a property to adsorb radioactive nuclides in the form of ion and/or molecule onto its surface is at least one member selected from the group consisting of fibrous active carbon, ion exchange fibers, and alkali metal titanate fibers.

6. A structure according to claim 2, wherein the fibrous material having a property to adsorb radioactive nuclides in the form of ion and/or molecule onto its surface is at least one member selected from the group consisting of fibrous active carbon, ion exchange fibers, and alkali metal titanate fibers.

7. A solidifying material according to claim 1, wherein the fibrous material having a property to adsorb radioactive nuclides in the form of ion and/or molecule onto its surface is fibrous active carbon and has an aspect ratio of 200–300.

8. A structure according to claim 2, wherein the fibrous material having a property to adsorb radioactive nuclides in the form of ion and/or molecule onto its surface is fibrous active carbon and has an aspect ratio of 200–300.

9. A solidifying material according to claim 1, wherein the fibrous material having a property to adsorb radioactive nuclides in the form of ion and/or molecule onto its surface is fibrous active carbon having micropores on its surface.

10. A structure according to claim 2, wherein the fibrous material having a property to adsorb radioactive nuclides in the form of ion and/or molecule onto its surface is fibrous active carbon having micropores on its surface.

11. A solidifying material according to claim 9, wherein the micropores have an average pore diameter of 10–25 Å.

12. A structure according to claim 10, wherein the micropores have an average pore diameter of 10–25 Å.

13. A solidifying material according to claim 1, wherein the fibrous material having a property to adsorb radioactive nuclides in the form of ion and/or molecule onto its surface is fibrous active carbon having a diameter on the order of about 10 to 15 μm and a fiber length of about 3 mm.

14. A structure according to claim 2, wherein the fibrous material having a property to adsorb radioactive nuclides in the form of ion and/or molecule onto its surface is fibrous active carbon having a diameter on the order of about 10 to 15 μm and a fiber length of about 3 mm.

15. A solidifying material according to claim 1, wherein an amount of the fibrous material having a property to adsorb radioactive nuclides in the form of ion and/or molecule onto its surface is about 5% by weight or less of said solidifying material.

16. A structure according to claim 2, wherein an amount of the fibrous material having a property to adsorb radioactive nuclides in the form of ion and/or molecule onto its surface is about 5% by weight or less of said structure.

17. A solidifying material for disposal of radioactive wastes in solidified waste form which comprises an admixture of a cement type hydraulic solidifying material and fibrous active carbon having micropores on its surface.

18. A structure for disposal of radioactive wastes at least a part of which structure is composed of a cement type hydraulic solidifying material wherein said cement type hydraulic solidifying material contains fibrous active carbon having micropores on its surface.

19. A process for solidifying radioactive wastes which comprises a step of feeding the waste into a kneading tank, a step of pouring a cement type hydraulic solidifying material into the kneading tank, a step of adding to the kneading tank a fibrous material having a property to adsorb radioactive nuclides in the radioactive wastes in the form of ion and/or molecule onto its surface, a step of adding water to the kneading tank, a step of kneading the wastes, the hydraulic solidifying material, the fibrous material and water in the kneading tank, and a step of pouring the kneading product obtained at the kneading step into a waste container to solidify the kneaded product; the fibrous material also having properties to increase retention of the radioactive wastes in the solidified kneaded product and to increase the tensile strength of the solidified kneaded product thereby increasing the waste loading therein.

20. A process for solidifying radioactive wastes which comprise a step of feeding the wastes into a waste container, a step of kneading a cement type hydraulic solidifying material, a fibrous material having a property to adsorb radioactive nuclides in the wastes in the form of ion and/or molecule onto its surface and water in a kneading tank, a step of pouring the kneaded product obtained in the kneading step into said waste container to solidify the product within said waste container, the fibrous material also having properties to increase retention of the radioactive wastes within the waste form and to increase the tensile strength of the product, thereby increasing the waste loading therein.

21. A process for solidifying radioactive wastes which comprises a step of feeding the wastes into a waste container, a step of pouring a cement type hydraulic solidifying material into the waste container, a step of pouring into the waste container a fibrous material having a property to adsorb radioactive nuclides in the wastes in the form of ion and/or molecule onto its surface, a step of adding water to the waste container, and a step of kneading and curing the wastes, the hydraulic solidifying material, the fibrous material and water in the waste container thereby to set the kneaded and cured product; the fibrous material also having properties to increase retention of the radioactive wastes within the waste form and to increase the tensile strength of the product, thereby increasing the waste loading therein.

22. A solidifying material for disposal of radioactive wastes and for making a solidified waste form which comprises an admixture of a cement type hydraulic solidifying material and fibrous material exhibiting the ability to increase the distribution coefficient of the radioactive wastes in the waste form, and the ability to increase the tensile strength of the waste form, thereby increasing the waste loading in the waste form.

23. A solidifying material according to claim 22, wherein the fibrous material comprises ion exchange fibers having functional groups, said fibers adsorbing at least anion of radioactive nuclides dissolved in liquid by ion exchange reaction with said functional groups.

24. A solidifying material according to claim 23, wherein said fibrous material comprises fibrous active carbon, having a property to adsorb nuclides in the form of at least anion or molecule onto its surface and having micropores on its surface.

25. A solidifying material according to claim 22, wherein said fibrous material is at least one member selected from the group consisting of fibrous active carbon, at least anion exchange fibers and alkali metal titanate fibers.

26. A solidified waste form, which comprises radioactive wastes and a mixture of a cement type hydraulic solidifying material and a fibrous active carbon, said waste form containing the radioactive wastes in an amount of 25–60 wt. %.

27. A solidified waste form according to claim 26, wherein said waste form also has a distribution coefficient of carbon-14 which increases with addition of the fibrous active carbon.

28. A solidified waste form comprising radioactive wastes admixed with a solidifying cement material and a fibrous material, said fibrous material having a property to increase both the distribution coefficient of said radioactive wastes in said waste form and the packing rate of the wastes within said waste form, the radioactive wastes constituting at least 25% by weight of the waste form and the fibrous material constituting no more than 10% by weight of the solidifying cement material.

29. A solidified waste form containing radioactive wastes, solidifying cement material and fibrous material, said fibrous material having a property to adsorb radioactive nuclides in the radioactive wastes in the form at least anion and/or molecule onto its surface and an average micropore diameter of 10–25 Å on its surface, or a property to adsorb at least anion of said radioactive nuclides dissolved in liquid by ion exchange reaction with functional groups contained in the fibrous material; said fibrous material also having the properties to increase the distribution coefficient of the radioactive waste within said waste form, the tensile strength of the waste form and the packing rate of the wastes within said waste form.

30. A solidifying material according to claim 1, wherein the waste form exhibits a compressive strength of at least 30 kg/cm$^2$ after the waste form is cured for one month and is dipped in water for one month.

31. A solidifying material according to claim 22, wherein the waste form exhibits a compressive strength of at least 30 kg/cm$^2$ after the waste form is cured for one month and is dipped in water for one month.

32. A solidifying waste form according to claim 26, wherein the waste form exhibits a compressive strength of at least 30 kg/cm$^2$ after the waste form is cured for one month and is dipped in water for one month.

33. A solidified waste form comprising radioactive wastes admixed with a solidifying cement material and a fibrous material, the fibrous material having a property to increase both the distribution coefficient of the radioactie wastes in the waste form and a packing rate of the wastes within said waste form.

34. A process for solidifying radioactive wastes which comprises a step of feeding the wastes into a kneading tank, a step of pouring a cement type hydraulic solidifying material into the kneading tank, a step of adding to the kneading tank a fibrous material having a property to adsorb radioactive nuclides in the wastes in the form of ion and/or molecule onto its surface, a step of adding water to the kneading tank, a step of kneading the wastes, the hydraulic solidifying material, the fibrous material and water in the kneading tank, and a step of pouring the kneading product obtained at the kneading step into a waste container to solidify the kneaded product; the fibrous material both increasing the tensile strength of the product and increasing the distribution coefficient of the radioactive nuclides in said product, thereby increasing the waste loading in the product.

35. A process for solidifying radioactive wastes which comprises a step of feeding the wastes into a waste container, a step of kneading a cement type hydraulic solidifying material, a fibrous material having a property to adsorb radioactive nuclides in the wastes in the form of ion and/or molecule onto its surface and water in a kneading tank, a step of pouring the kneaded product obtained in the kneading step into said waste container to solidify the product within said waste container, the fibrous material both increasing the tensile strength of the product, and increasing the distribution coefficient of the radioactive nuclides in said product, thereby increasing the waste loading in said product.

36. A process for solidifying radioactive wastes which comprises a step of feeding the wastes into a waste container, a step of pouring a cement type hydraulic solidifying material into the waste container, a step of pouring into the waste container a fibrous material having a property to adsorb radioactive nuclides in the wastes in the form of ion and/or molecule onto its surface, a step of adding water to the waste container, and a step of kneading and curing the wastes, the hydraulic solidifying material, the fibrous material and water in the waste container thereby to set the kneaded and cured product; the fibrous material both increasing the tensile strength of the product and increasing the distribution coefficient of the radioactive nuclides in said product, thereby increasing the waste loading in said product.

37. A process for producing a structure for disposal of radioactive wastes which comprises the steps of mixing a fibrous material having a property to adsorb radioactive nuclides in the wastes in the form of ion and/or molecule onto its surface, a cement-type hydraulic solidifying material and water and solidifying the resultant admixture to form said structure.

* * * * *